US008469250B2

(12) United States Patent
Zhou

(10) Patent No.: US 8,469,250 B2
(45) Date of Patent: Jun. 25, 2013

(54) AUTO HAMMER

(75) Inventor: Hongtao Zhou, Nanjing (CN)

(73) Assignee: Chervon Limited, Hong Kong (HK)

( * ) Notice: Subject to any disclaimer, the term of this patent is extended or adjusted under 35 U.S.C. 154(b) by 353 days.

(21) Appl. No.: 12/948,317

(22) Filed: Nov. 17, 2010

(65) Prior Publication Data

US 2011/0114349 A1 May 19, 2011

(30) Foreign Application Priority Data

Nov. 19, 2009 (CN) ..... 2009 1 0234451
Nov. 19, 2009 (CN) ..... 2010 1 0003063

(51) Int. Cl.
*B25C 1/06* (2006.01)

(52) U.S. Cl.
USPC ..... 227/147; 227/119; 227/149; 81/44; 81/464; 269/229

(58) Field of Classification Search
USPC ..... 227/119, 140, 144, 147, 149; 81/44, 81/454–455, 463, 464; 269/229, 237, 3, 6
See application file for complete search history.

(56) References Cited

U.S. PATENT DOCUMENTS

| | | | | |
|---|---|---|---|---|
| 1,726,012 | A * | 8/1929 | Bilz | 227/147 |
| 7,017,790 | B1 * | 3/2006 | Peng | 227/119 |
| 7,789,282 | B2 * | 9/2010 | Fukinuki et al. | 227/131 |
| 7,963,430 | B2 * | 6/2011 | Fukinuki et al. | 227/131 |
| 2008/0054043 | A1 * | 3/2008 | Beales | 227/129 |
| 2009/0045241 | A1 * | 2/2009 | Fukinuki et al. | 227/131 |
| 2011/0114696 | A1 * | 5/2011 | Zhou | 227/140 |

FOREIGN PATENT DOCUMENTS

| | | | |
|---|---|---|---|
| DE | 3516541 | A1 | 11/1986 |
| GB | 2030485 | A * | 4/1980 |
| WO | 2006/008546 | A2 | 1/2006 |

* cited by examiner

*Primary Examiner* — M. Alexandra Elva
*Assistant Examiner* — Andrew M Tecco
(74) *Attorney, Agent, or Firm* — Greenberg Truarig, LLP

(57) ABSTRACT

An auto hammer with a striking device includes a striking rod and a clamping mechanism. The striking rod continually strikes a component to gradually insert the component into a workpiece. The clamping mechanism includes at least one clamping element, a biasing device, a bush and a sleeve, and the clamping elements are movable between a closed position and an opened position. The bush is arranged around the striking rod so as to prevent the nail head from becoming trapped in a gap which is formed after the clamping elements are entirely opened. The biasing device is arranged for biasing the bush toward the direction of striking the component. This clamping mechanism can reliably clamp nails or other components to facilitate user operation of the device.

19 Claims, 11 Drawing Sheets

AUTO HAMMER

BACKGROUND

Auto hammers are commonly used as portable tools in decoration and construction fields. Chinese Patent Application No. 200820161342.1 discloses an auto hammer which comprises a main body and a muzzle part connected to the main body. The muzzle part is generally composed of a hollow cylindrical sleeve in which a hole for receiving a magnet is drilled. The magnet is engaged in the hole for attaching a nail placed in a striking device to clamp the nail. The disadvantages of such auto hammer are that: the magnet is located at the edge of the sleeve, so that the nail cannot be positioned at the centre of the sleeve and cannot be parallel to the centre line of the sleeve (i.e., the attached nail is deflected). The magnet also cannot clamp other non-magnetic materials, such as wooden tenons and the like.

SUMMARY

Provided is an auto hammer, in which nails or other components can be securely clamped within a striking device for convenience of the user.

To this end, an auto hammer, which provides convenient operation, better visibility and a compact structure, comprises a striking device including a striking rod and a clamping mechanism. The striking rod continually strikes a component to gradually insert the component into a workpiece. The clamping mechanism includes at least one clamping element, a biasing device, a bush and a sleeve, and the clamping elements are movable between a closed position and an opened position. The bush is arranged around the striking rod so as to prevent the nail head from becoming trapped in a gap which is formed after the clamping elements are entirely opened. The biasing device is arranged for biasing the bush toward the direction of striking the component.

The auto hammer may also comprise a first biasing device for biasing the sleeve toward the direction of striking the component and a second biasing device for biasing a ferrule toward the direction of striking the component such that the clamping elements are biased. In operation, at the beginning, nails or other components can be securely clamped within the clamping mechanism. When the sleeve contacts the workpiece, the user has to counteract the pressure exerted by the first biasing device to open the clamping elements; when the end surface of the body of the clamping mechanism contacts the workpiece, the body will move together with the sleeve by counteracting the pressure exerted by the first biasing device and the second biasing device.

Further, the auto hammer comprises a housing and a motor mounted vertically in the housing. An impact wheel includes at least one projection for impacting the striking rod. A transmission mechanism is arranged in the housing for converting rotating motions of the motor into impact motions of the striking rod via a bevel gear and the impact wheel. Nails or other components can be securely clamped by the clamping mechanism during using the auto hammer.

The sleeve is provided with slot groups on at least two sides thereof, and the slots on each side are symmetric to each other. The clamping elements comprise driving portions which are disposed in the slots and movable along the slots. Preferably, the sleeve is provided with slot groups on four sides thereof, and the slots on each side are symmetric to each other. The driving portions of the clamping elements are disposed in the slots and movable along the slots. Due to the arrangement that the slot groups are configured on four sides of the sleeve, the clamping elements can clamp the shank of the nail in a wider range to obtain a better effect of clamping.

Further, the slots are configured as flexural-type to advantageously shorten the sliding distance of the sleeve, and then the structure of the entire device is more compact.

Further, the driving portions are mounted removably on the clamping elements and/or integrated with the clamping elements.

Further, the clamping elements include any one or any combination of a jaw, a spring, a magnet, a screw or a chuck for retaining a component.

Further, the clamping elements include recesses, and one component is retained in the recesses at the closed position, or disengaged from the recesses at the opened position.

Further, the striking device includes a striking rod which passes through a released region formed by the clamping elements at the opened position.

Further, the clamping mechanism includes a bush which passes through the released region. The bush is arranged around the nail head all along, so as to prevent the nail head trapping into the gap which is formed after the clamping elements are entirely opened.

Further, the clamping elements are interlocked to advantageously open or close the clamping elements simultaneously.

Further, the sleeve includes a locking mechanism which includes at least one protrusion and a spanner, the clamping elements are located at the opened position after one protrusion and the spanner are interlocked, and the bush is exposed from the sleeve after another protrusion and the spanner are interlocked.

Further, the sleeve is provided with a sheath, and a toggle switch engages with the sheath for moving together therewith. The user may open the clamping elements by pushing and pressing the sheath or pushing the toggle switch.

Further, the sheath and/or the sleeve are composed of transparent material for conveniently determining the specific position of the striking rod by the user.

Further, the sheath and/or the sleeve are provided with recesses thereon for increasing the visibility of the component.

BRIEF DESCRIPTION OF THE DRAWINGS

The detailed embodiments of the present invention are described below in conjunction with the accompanied drawings, in which.

DETAILED DESCRIPTION

Figure 1:
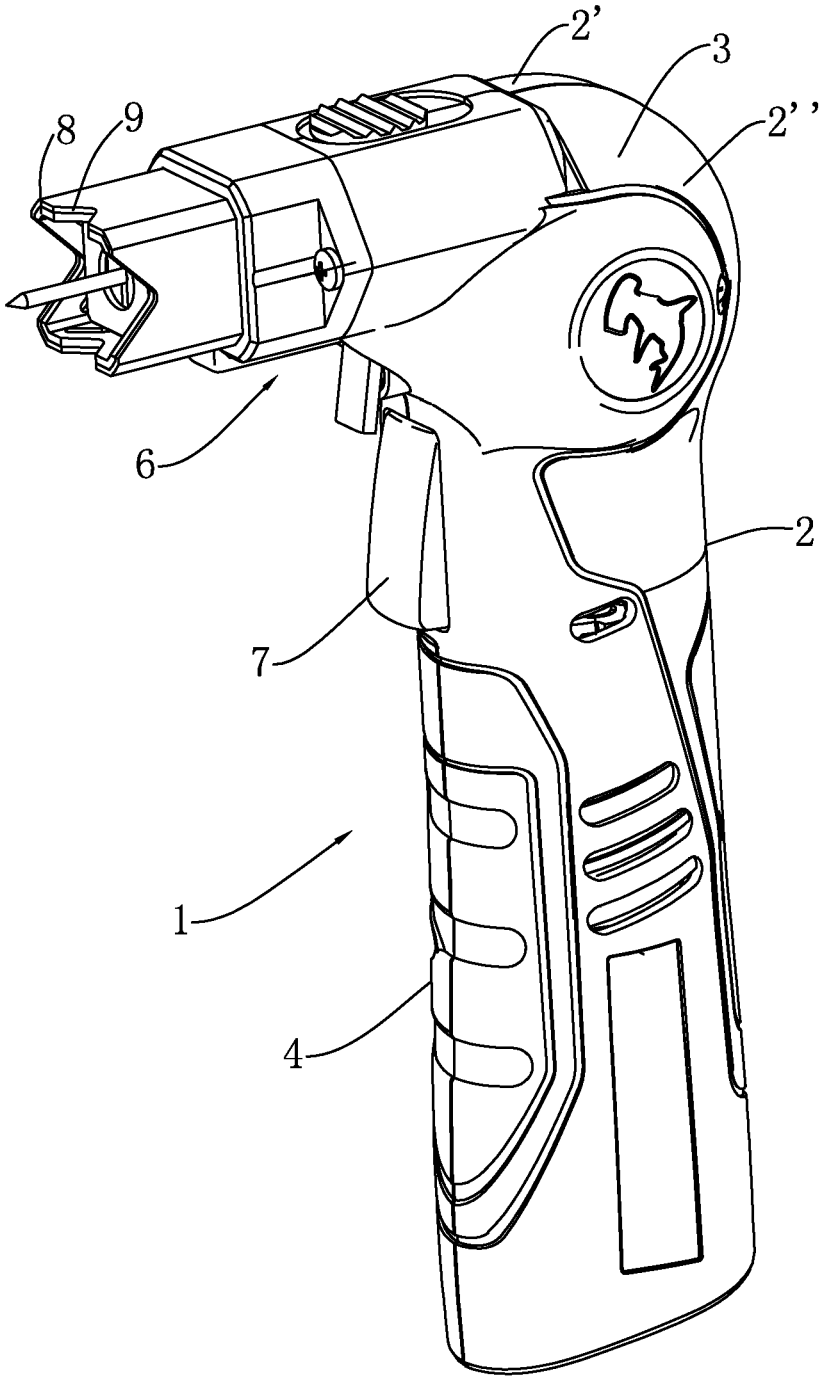
FIG. 1 is a perspective view of an auto hammer according to present invention.
Figure 2:
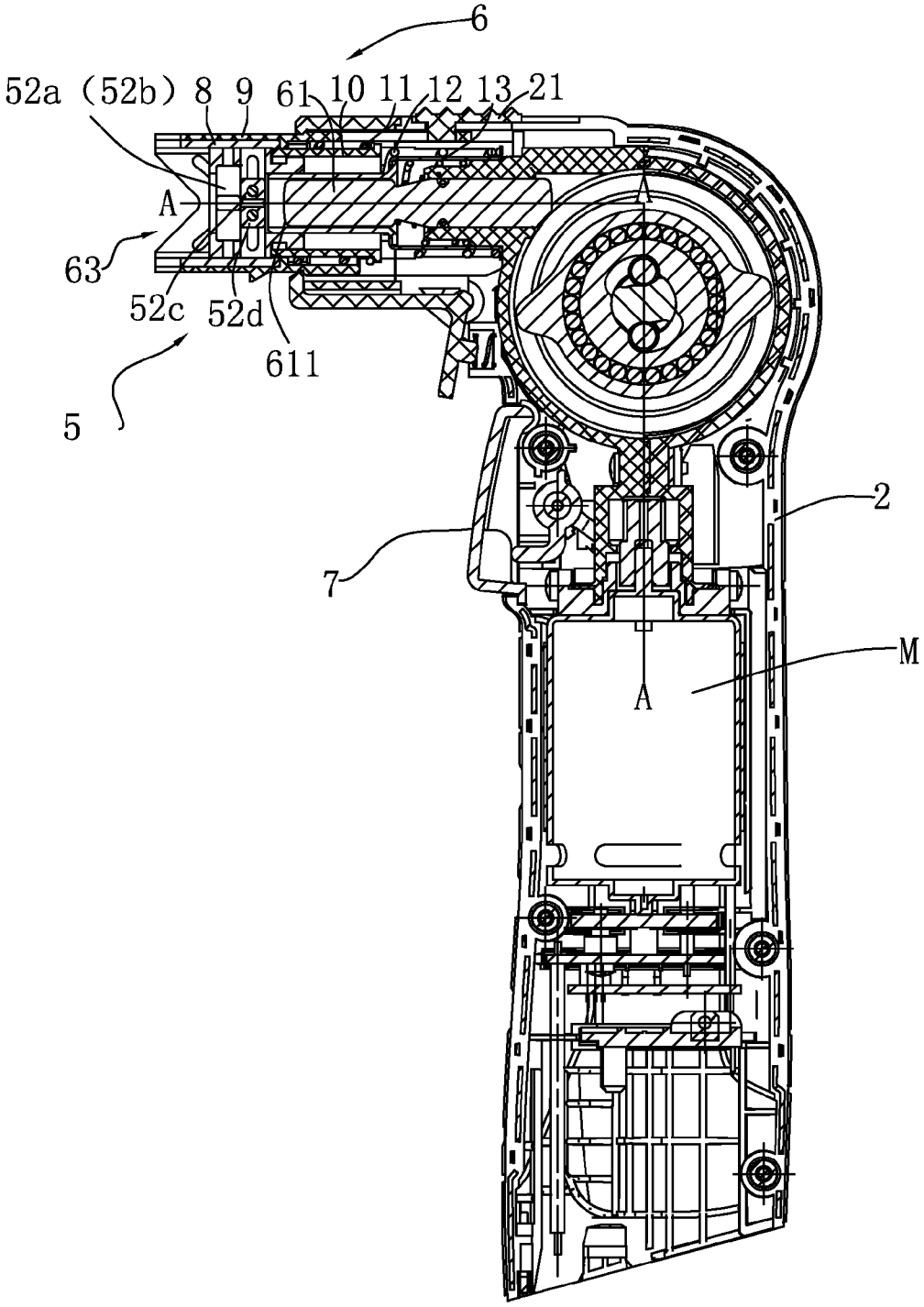
FIG. 2 is a sectional view of the auto hammer of FIG. 1 taken along a combination surface of the two half housings.

As shown in FIGS. 1 and 2, an auto hammer 1 of an exemplary embodiment includes a housing 2 containing a motor M and a striking device 6. The housing 2 is formed by combining a left half housing 2' with a right half housing 2". A substantially vertical grip 4 is formed by the main body of the housing 2 and the upper portion of the housing 2 has a head assembly 3 which includes a transmission mechanism and the striking device 6 formed by protruding forwardly.

In this embodiment, the auto hammer 1 comprises a battery pack (not shown) for supplying electricity to the motor M. However, the auto hammer according to the invention need not be restricted to the use of a DC power supply and may be equally powered by a source of AC power. A switch 7 is arranged on the housing 2 for controlling the motor M to start or stop. The striking device 6 includes a striking rod 61 mounted therein by a spring. The striking rod 61 is disposed substantially horizontally and moves in a reciprocating manner within the striking device 6. During operation, the end surface of the striking end 611 of the striking rod 61 acts on the components such as fasten pieces like nails, and tenons or objects like bricks and so on. The striking device 6 further includes a receiving cavity 63, the inner diameter of which is larger than the diameters of the nails commercially used or other components, thus nails or other components with different sizes can be placed therein.

Figure 3:
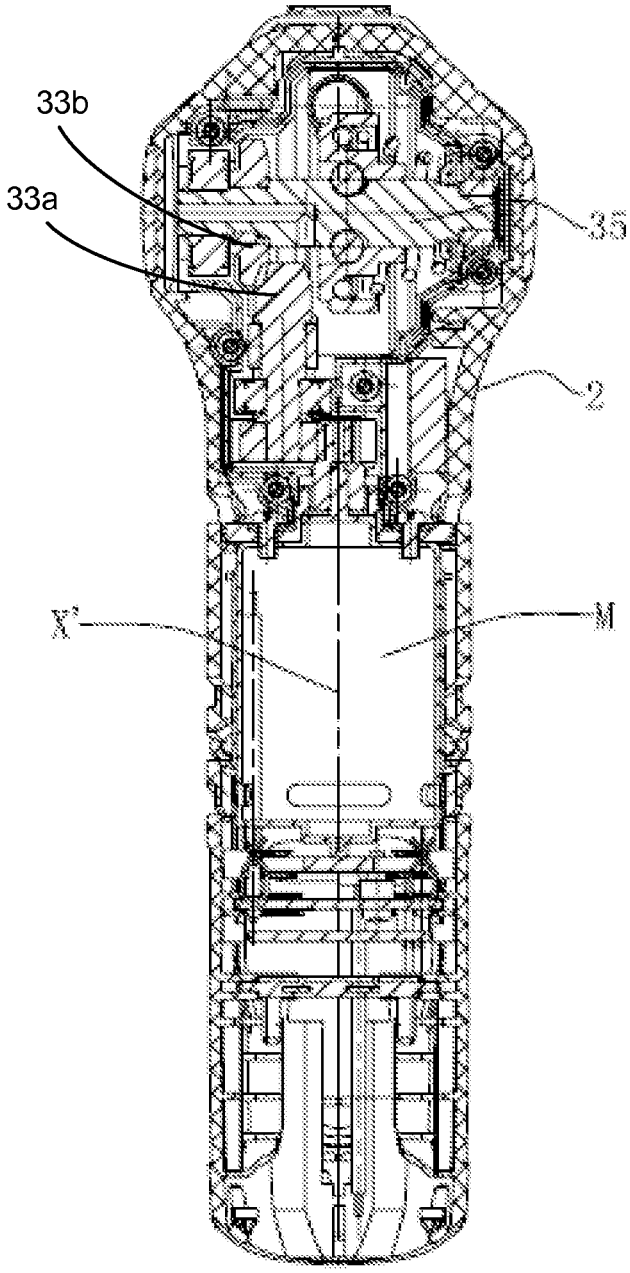
FIG. 3 is a sectional view of the auto hammer of FIG. 1 taken along a direction perpendicular to the combination surface of the two half housings.
Figure 4:
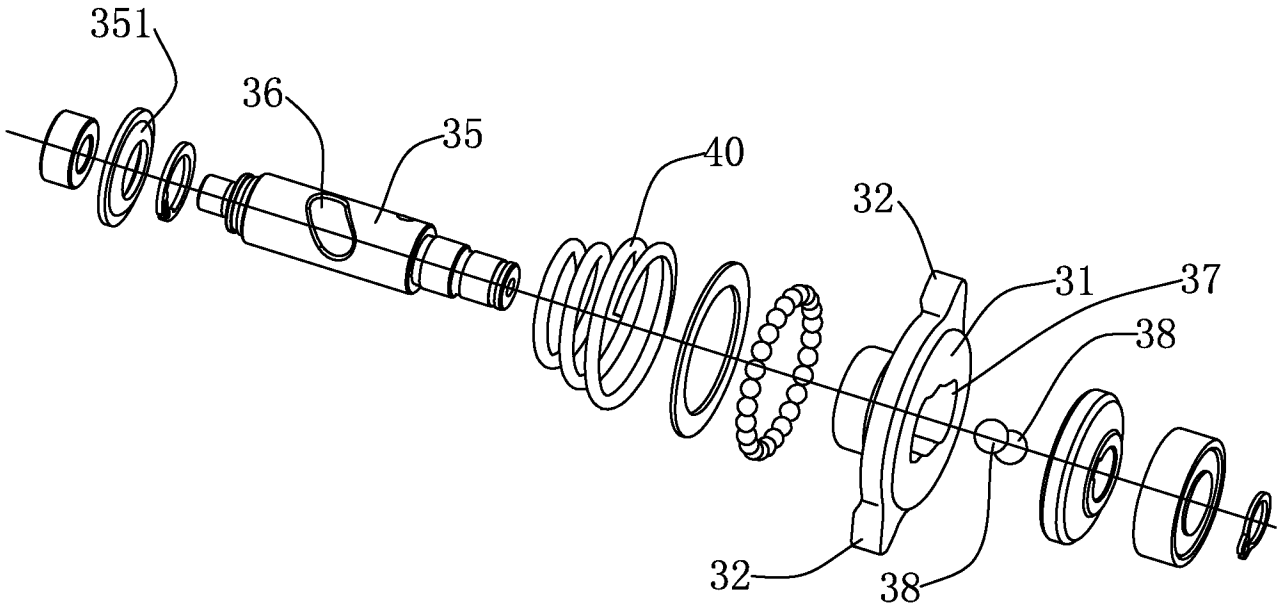
FIG. 4 is a partially exploded view illustrating a transmission mechanism of the auto hammer of FIG. 1.
Figure 5:
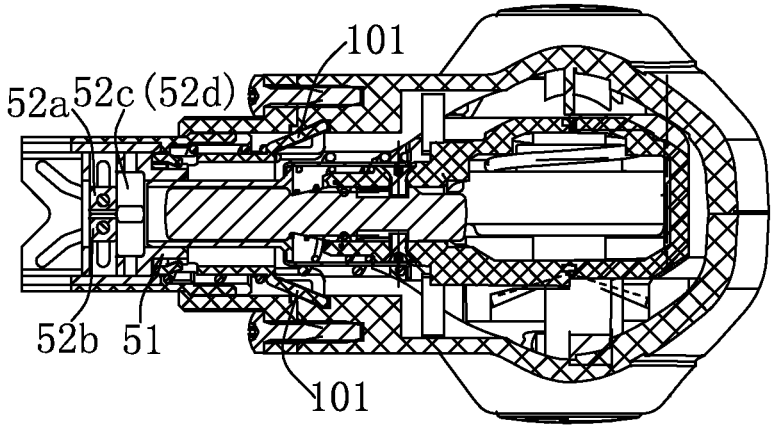
FIG. 5 is a cutaway view of the auto hammer of FIG. 2 taken along axis A-A.

As shown in FIGS. 3 and 4, a rotation-linear motion transmission mechanism is arranged in the housing 2 for converting rotating motions of the motor M into impact motions of the striking rod 61. The motor M is mounted vertically in the housing 2 with an upward motor shaft X' thereof transmitting the rotation power to a rotating shaft 35 by means of a multi-stage gear transmission mechanism including bevel gears 32*a*, 32*b*. The rotating shaft 35 is supported on the upper portion of the housing by two bearings at opposite ends. A pair of inclined slots 36, each of which is "V" shaped and opens backwardly, is formed on the rotating shaft 35. An impact wheel 31 is mounted on the rotating shaft 35, which is a generally hollow cylinder and is provided with a pair of curved guiding slots 37 which is formed on its inner cylindrical surface and opposite to the inclined slots 36 respectively. The opening of the curve of each guiding slot 37 is orientated opposite to the "V" shaped inclined slot 36. The bottom of the inclined slots 36 and the guiding slots 37 are semicircle. A pair of steel balls 38 is arranged respectively in the chambers formed by the corresponding inclined slots 36 and the guiding slots 37 and can move along the inclined slots 36 and the guiding slots 37. The impact wheel 31 can thus be driven to rotate through the steel balls 38 located in the inclined slots 36 when the rotating shaft 35 is rotated. A pair of projections 32, which is disposed oppositely along the diameter direction of the impact wheel 31, is provided on the outer periphery of the impact wheel 31. When the switch 7 is triggered, the motor M is actuated and drives the rotating shaft 35 to rotate by the multi-stage gear transmission mechanism. As a result, the rotating shaft 35 then drives the impact wheel 31 to rotate therewith via the steel balls 38.

As shown in FIG. 4, an energy storing spring 40 is mounted between the impact wheel 31 and the rotating shaft 35 in such a manner that one end of the spring abuts against a shoulder 351 of the rotating shaft 35 and the other end thereof abuts against the impact wheel 31. The axial force of this energy storing spring 40 may cause the impact wheel 31 to locate at a first axial position relative to the rotating shaft 35. At this first axial position, the impact wheel 31 rotates circumferentially under the action of the rotating shaft 35 and the steel balls 38. If the impact wheel 31 rotates to a position where the projections 32 may come into contact with the striking rod 61, the striking rod 61 stops the rotation of the impact wheel 31 temporarily because it encounters a larger resistance which cannot be overcome temporarily. As a result, the impact wheel 31 is forced to gradually press the energy storing spring 40 and thereby moves from the first axial position to a second axial position. At this second axial position, the projections 32 of the impact wheel 31 depart from the striking rod 61 and then the braking is released. At this moment, the energy storing spring 40 starts to release the elastic potential energy thereof. Under the function of the rebound force of the energy storing spring 40, the impact wheel 31 is axially pressed back to its first axial position, and is moved at a higher speed than that of the rotating shaft with the cooperation of the inclined slots 36, the guiding slots 37 and the steel balls 38. As a result, the stricken end 612 of the striking rod 61 is impacted by the projections 32 of the impact wheel 31 to make the striking rod 61 moves linearly at high efficiency, and thus a strike action is achieved. After the first striking action is completed, when the impact wheel 31 rotates to be stopped by the striking rod 61 again, it enters into a second impact cycle, and the succeeding impact cycles will be achieved in the same manner.

Figure 6:
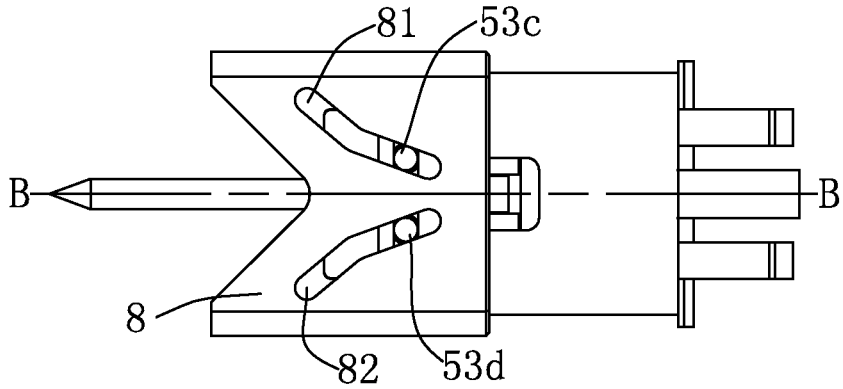
FIG. 6 is a detailed plan view illustrating a clamping mechanism of the auto hammer of FIG. 1, wherein the clamping elements are located in a closed position.
Figure 7:
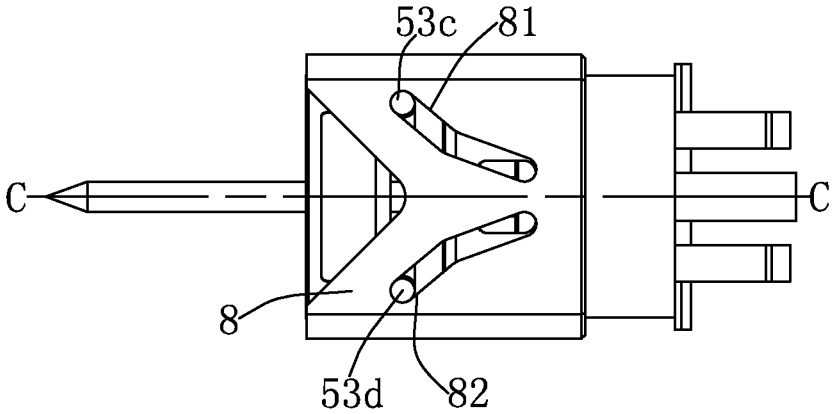
FIG. 7 is a detailed plan view illustrating a clamping mechanism of the auto hammer of FIG. 1, wherein the clamping elements are located in an opened position.
Figure 8:
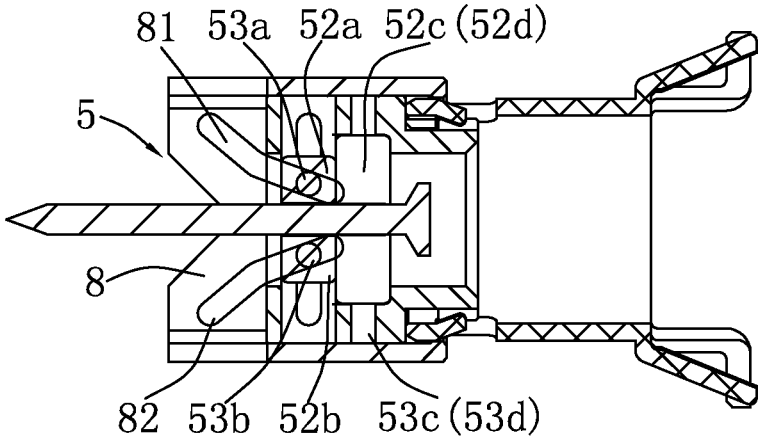
FIG. 8 is a cutaway view of the clamping mechanism of FIG. 6 taken along axis B-B.
Figure 9:
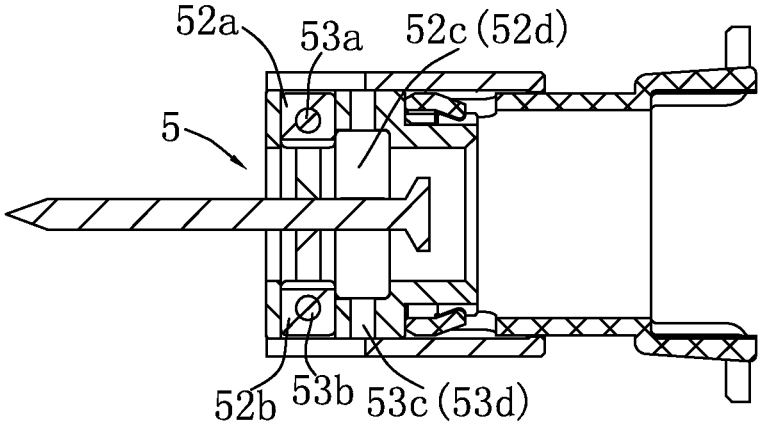
FIG. 9 is a cutaway view of the clamping mechanism of FIG. 7 taken along axis C-C.

With reference to FIGS. 2 and 5-9, the striking device 6 further includes a clamping mechanism 5 therein for clamping the nails or other components. The clamping mechanism 5 is composed of clamping elements 52*a*, 52*b*, 52*c* and 52*d* and mounted in the body 51 of the clamping mechanism 5. The clamping elements 52*a*, 52*b*, 52*c* and 52*d* generally have a first position and a second position. At the first position, i.e., a closed position, the clamping elements 52*a* and 52*b* are closed with respect to each other, and the clamping elements 52*c* and 52*d* are also closed with respect to each other to create a clamped region in which the nails or other components may be retained, as shown in FIGS. 6 and 8. At the second position, i.e., a opened position, the clamping elements 52*a* and 52*b* are opened with respect to each other, and the clamping elements 52*c* and 52*d* are also opened with respect to each other to create a state in which the nails may be struck continually by the striking rod until the nail is completely nailed into the workpiece, as shown in FIGS. 7 and 9. When the clamping elements are located in the opened position, the nails or other components may be placed into the receiving cavity 63 and retained in the clamped region upon the clamping elements being closed. Each clamping element is provided with a recess which may exactly engage with the arc of the shank of the nail. The clamping effect will be enhanced if the contact areas between the clamping elements and the shanks of the nails or other components are increased. Also, the nails or other components with different sizes can be retained independently by the clamping elements since the clamping elements can be adjusted. Once the clamping elements are opened, the nails or other components can be disengaged from the recesses.

The clamping elements as mentioned above may be any one or any combination of jaw, spring, magnet, screw or chuck and the like for retaining elements.

As shown in FIGS. 6-9, a sleeve 8 is configured as a hollow cuboid and provided with inclined slots. Two symmetrical inclined slots 81 and 82 are disposed on each of four sides (i.e., front side, rear side, top side and bottom side) of the sleeve. The inclined slots on the front side are shown in FIG. 6, and the inclined slots on other three sides are arranged similarly. The inclined slots 81 and 82 may also be disposed integrally to form a "V" shaped slot. Moreover, the inclined slots 81 and 82 are not linear-type but flexural-type inclined slots, which is advantageous to shorten the stroke of the sleeve 8, and make the structure of the entire device more compact. The flexural-type inclined slots depicted herein refer to non-linear-type recesses, including curved recesses and recesses formed by two or more lines with different slopes and the like. Two driving portions 53*a*, 53*b* of the clamping elements pass through the clamping elements 52*a*, 52*b* respectively, and each of them is mounted at opposite ends into the corresponding inclined slots 81, 82 on the top and bottom sides of the sleeve 8. The other two driving portions 53*c*, 53*d* pass through the clamping elements 52*c*, 52*d* respectively, and each of them is mounted at opposite ends into the corresponding inclined slots 81, 82 on the front and rear sides of the sleeve 8. An interlock structure is formed by the four driving portions. When the clamping elements are located in the first position, i.e., the closed position, four clamping elements clamp the nail in the manner that the opposite ends of the driving portion 53*a* are respectively positioned at one end of the corresponding inclined slots 81 on the top and bottom sides of the sleeve 8, the opposite ends of the driving portion 53*b* are respectively positioned at one end of the corresponding inclined slots 82 on the top and bottom sides of the sleeve 8, the opposite ends of the driving portion 53*c* are respectively positioned at one end of the corresponding inclined slots 81 on the front and rear sides of the sleeve 8, and the opposite ends of the driving portion 53*d* are respectively positioned at one end of the corresponding inclined slots 82 on the front and rear sides of the sleeve 8. The four driving portions move together with respect to the respective inclined slots. As shown in FIGS. 7 and 9, when the clamping elements are located in the second position, i.e., the opened position, the four clamping elements are opened with respect to each other in the manner that the opposite ends of the driving portion 53*a* are respectively positioned at the other end of the corresponding inclined slots 81 on the top and bottom sides of the sleeve 8, and the opposite ends of the other driving portions are respectively positioned at the other end of the corresponding inclined slots on two sides of the sleeve, whereby the nail may be struck continually by the striking rod 61 passing through the clamping elements until it is totally nailed into the workpiece. It could be understood that the driving portions may be integrated with the clamping elements.

Upon assembly, each clamping element is firstly placed within the body 51 of the clamping mechanism, and then each driving portion is passed through the respective clamping element. A sheath 9, which may prevent the driving portions disengaging from the sleeve 8 and dropping out from the auto hammer, is further mounted on the outer surface of the sleeve 8. The body 51 is connected to one end of a ferrule 10 for moving therewith. It could be understood that, the driving portions also may be integrated with the clamping elements.

As shown in FIGS. 10-14, a first biasing device is provided in the form of a spring 11 for biasing the sleeve 8 toward the left, namely toward the workpiece to be processed, so that the clamping elements are located at the closed position. The spring 11 is mounted on the sleeve 8 at one end and on the protrusion of the ferrule 10 at the other end. When the sleeve 8 contacts the workpiece, the user has to counteract the pressure exerted by the first biasing device to open the clamping elements. A second biasing device is provided in the form of a spring 12 for biasing the ferrule 10 toward the left. The spring 12 is mounted on the ferrule 10 at one end and on a stop collar 13 at the other end. When the end surface 51*a* of the body 51 contacts the workpiece, the body 51 will move together with the sleeve 8 by counteracting the pressure exerted by the second biasing device. A third biasing device is provided in the form of a spring 14 for biasing a bush 15 toward the workpiece. The spring 14 is mounted on the gear box at one end and on the bush 15 at the other end. When the bush 15 contacts the workpiece, the bush 15 will move together with the sleeve 8 and the ferrule 10 by counteracting the pressure exerted by the third biasing device till the nail is totally nailed into the workpiece.

The springs as mentioned above may be compression springs or coil springs. The springs may be substituted with other elastic members or biasing members for producing attraction force or exclusion force, for example, the springs 11, 12 and 14 may be replaced by magnetic members.

Figure 10:
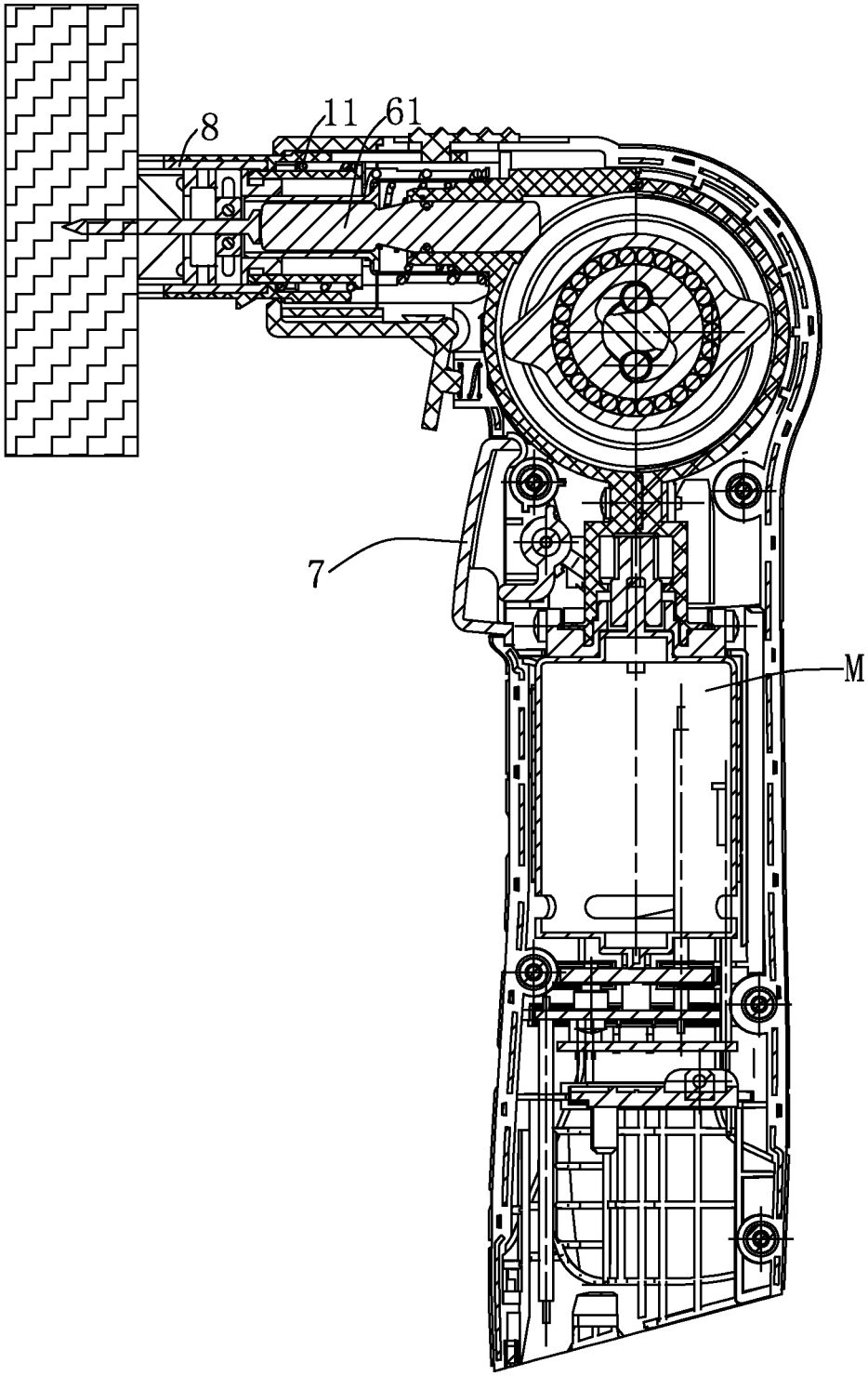
FIG. 10 is a schematic view illustrating that the nail is clamped in the clamping mechanism and the sleeve of the auto hammer exactly contacts the workpiece, at this moment, the clamping elements are located in the opened position.
Figure 11:
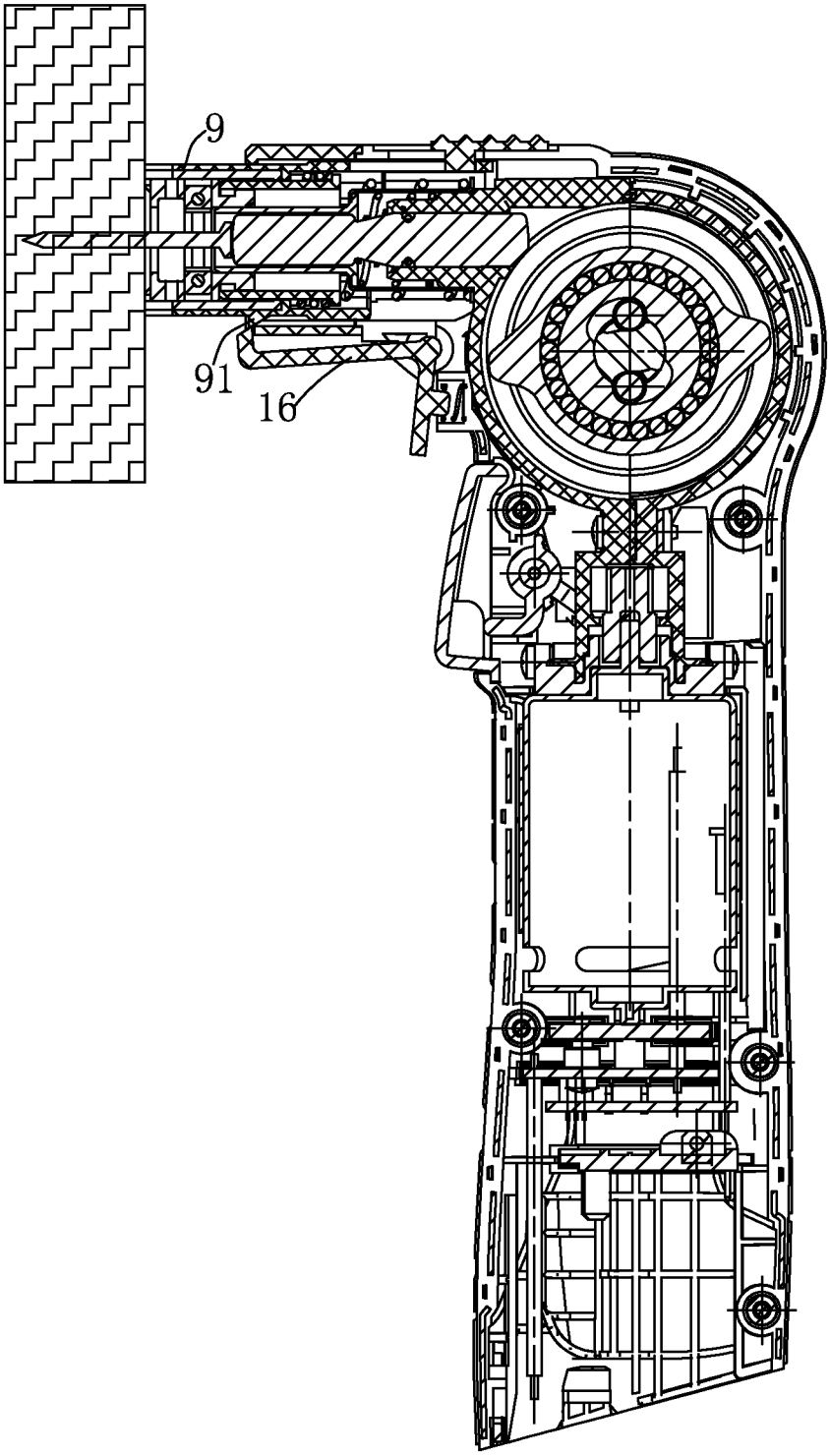
FIG. 11 is a schematic view illustrating that the nail is nailed into the workpiece, and the protrusions on the sleeve of the auto hammer exactly abuts against the spanner.
Figure 12:
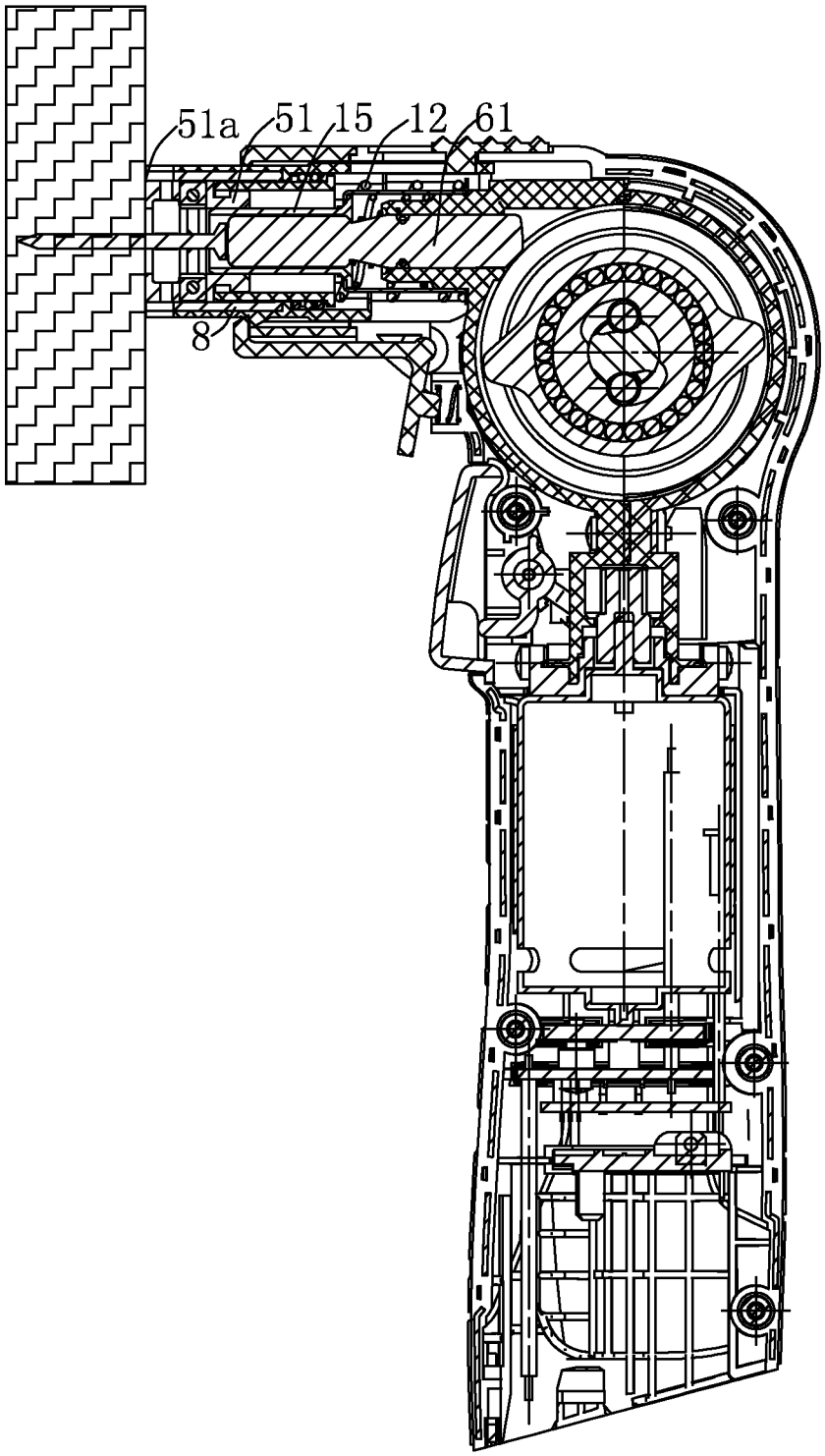
FIG. 12 is a schematic view illustrating that the nail is nailed into the workpiece, and the body of the clamping mechanism of the auto hammer exactly contacts the workpiece, at this moment, the clamping element are located in an entirely opened position.
Figure 13:
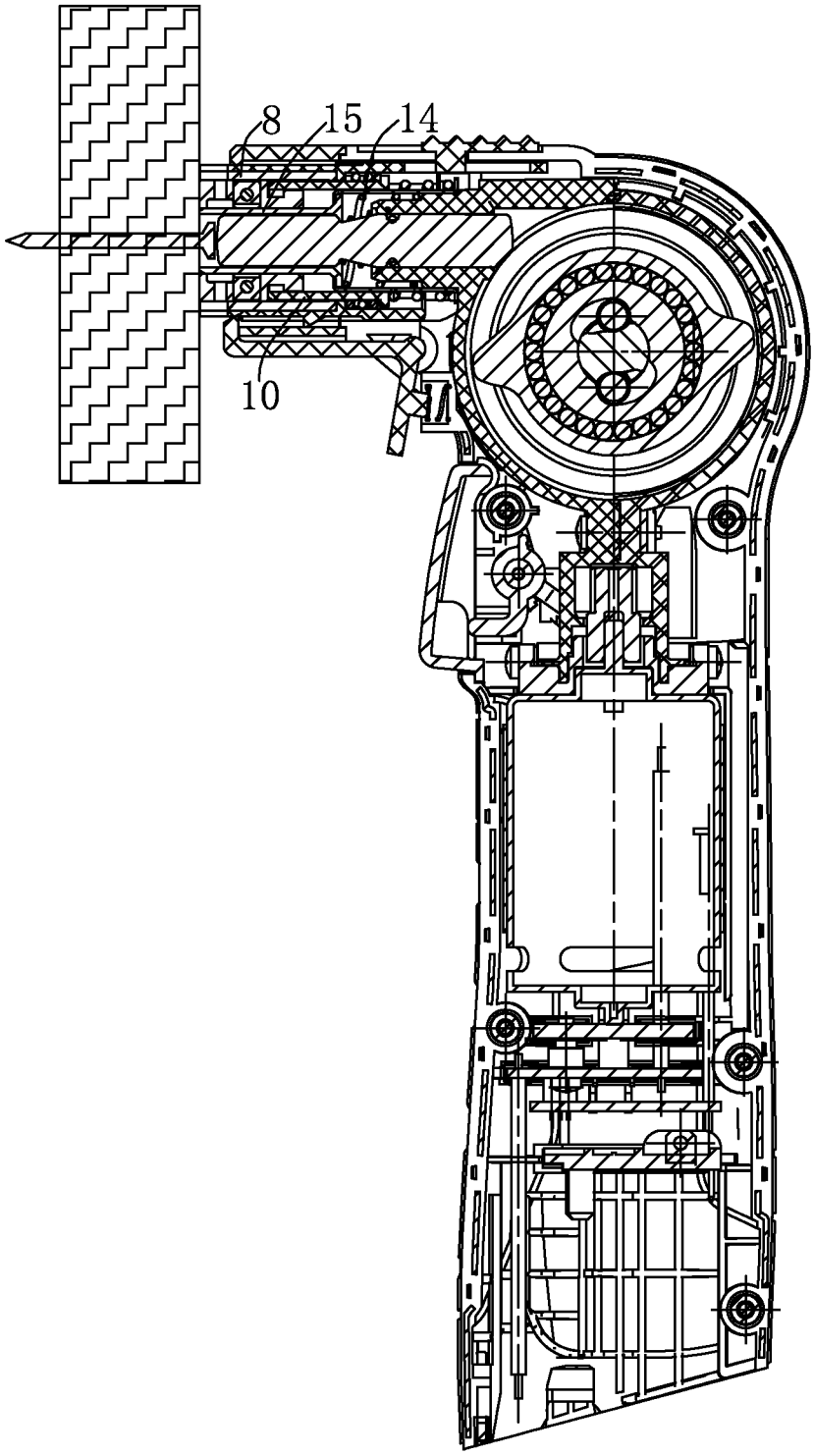
FIG. 13 is a schematic view illustrating that the nail is nailed into the workpiece, and the bush of the clamping mechanism of the auto hammer exactly contacts the workpiece.
Figure 14:
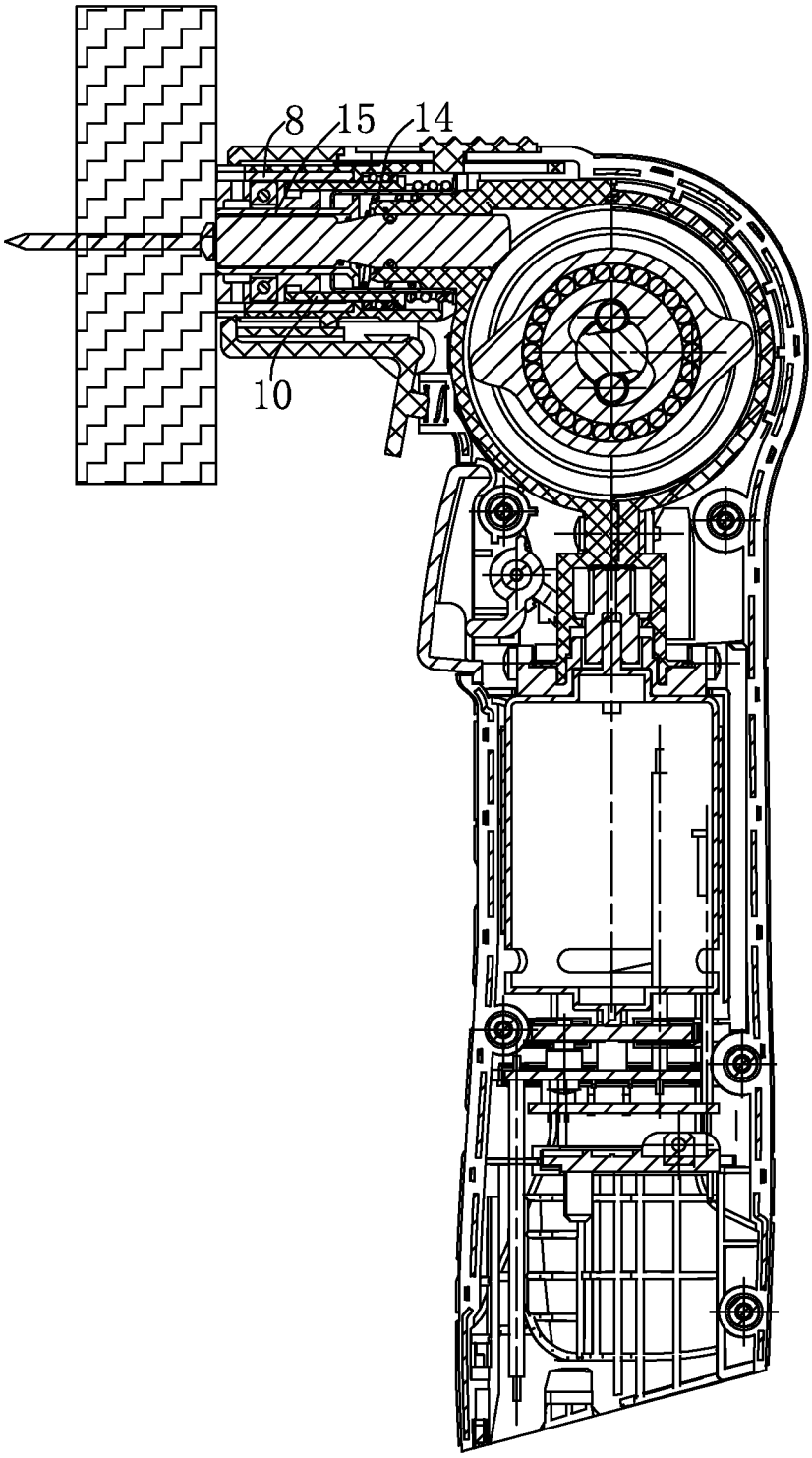
FIG. 14 is a schematic view illustrating that the nail is totally nailed into the workpiece.

In operation, if the clamping elements are located in the closed position as shown in FIG. 2, the user may overcome the pressure exerted by the first biasing device 11 through a toggle switch 21 to push the sleeve 8 to move in the right direction as pictured. The toggle switch 21 is mounted on the housing 2 and engages with the sheath 9. If the toggle switch 21 is moved by the user for driving the sleeve 8 and the sheath 9 to move together in the right direction as pictured, or the sleeve 8 is pressed directly to move in the right direction as pictured, the clamping elements will be totally opened and the user may hear a "click." The nail may now be placed in the receiving cavity 63 and then be retained individually by the clamping elements by releasing the spanner 16. Subsequently, the auto hammer is positioned to make the nail adjacent to the workpiece, and the switch 7 may be pushed when the battery pack (not shown) is loaded so as to activate the motor M for driving the striking rod 61 to move in a reciprocating manner. The head of the nail will be struck repeatedly by the striking rod 61 once the auto hammer is pressed on the workpiece by the user, so that the nail is inserted gradually into the workpiece. If the user wants to stop the strike before the clamping elements are opened, he may turn the toggle switch 21 to again move the sleeve 8, or press the sleeve 8 directly inwardly, so that the clamping elements are opened and thus the nail may disengage from the auto hammer. During the gradually inserting of the nail, as shown in FIG. 10, the user may overcome the pressure exerted by the spring 11 to open the clamping element when the sleeve 8 engages with the workpiece, which allows the nail to be inserted partly into the workpiece before being released. As shown in FIGS. 11 and 12, the sheath 9 includes at least one protrusion 91 at the lower end thereof, and the sheath 9 may push out the protrusions 101 on two sides of the ferrule 10 from the internal of the housing while the spanner 16 is pushed out by the protrusion 91, so that the body 51 may slide inwardly to the housing. Upon the end surface 51*a* of the body 51 contacting the workpiece, as shown in FIG. 12, the clamping elements are located in the opened position, the pressure exerted by the spring 12 is needed to be counteracted by the user to make the nail head available through the clamping elements, while the bush 15 and the striking rod 61 may also pass through the clamping elements to continually strike the nail. Upon the bush 15 contacting the workpiece, as shown in FIG. 13, the pressure exerted by the spring 14 is needed to be counteracted by the user to make the bush 15 flush around the nail head so as to prevent the nail head becoming trapped in any gap which may be formed after the clamping elements are entirely opened. The nail will thus be struck continually until it is nailed totally into the workpiece, as shown in FIG. 14.

The clamping mechanism further includes a locking mechanism such that the sheath 9 may be locked in the opened position of the clamping elements by the engagement of the protrusion 91 with the spanner 16 after the nail is nailed totally into the workpiece. The second strike will be achieved by repeating the steps as described above after placing one nail into the receiving cavity 63, and pressing the spanner 16 to clamp the nail in the receiving cavity 63 by the clamping elements. The sheath 9 may further include another protrusion at the lower end to lock the sheath 9 at another position, at which the bush 15 is exposed from the sleeve 8 to increase the visibility of the striking rod 61. At this moment, the striking end 611 of the striking rod 61 may be used as a knocking portion of the auto hammer, which may knock the workpiece to be processed such as tenon, brick and the like with the linear reciprocating movement of the striking rod 61 during operation. Whereby, the functions of this machine are increased rather than limited to strike the fastening elements into the workpiece. According to this embodiment, the sleeve 8 and the sheath 9 may be composed of transparent materials, such as transparent plastic, which may also enhance the visibility of the striking rod 61. If the specific position of the striking rod 61 can be determined, the striking rod 61 may be used as an auto hammer by the user to knock the workpiece to be processed. In addition, the "V" shaped recesses provided on the sleeve and the sheath can also enhance the visibility of the clamped nail in the case that the nail is smaller, so as to facilitate the operation.

In conclusion, the auto hammer described in this invention is not limited to the embodiments described above and the configurations shown in the drawings. There are many obvious variations, substitutes and modifications in the shapes and locations of the components based on the present invention, and such variations, substitutes and modifications shall all fall in the scope sought for protection in the present invention.

What is claimed is:

1. An auto hammer comprising:

a striking rod for continually striking a component in a direction to gradually insert the component into a workpiece; and a clamping mechanism including at least two clamping elements, a biasing device, a bush and a sleeve, wherein the sleeve is provided with slots, at least one of the clamping elements is movable in the slots relative to the sleeve such that the clamping elements are closed when located at a first position of the slots and the clamping elements are opened when located at a second position of the slots, wherein the biasing device is arranged for biasing the bush towards the component striking direction of the striking rod, and wherein the bush is arranged for preventing the component from becoming trapped in any gap formed between the clamping elements when the clamping elements are in the opened, second position.

2. The auto hammer of claim 1, wherein the auto hammer further comprises a second biasing device arranged for biasing the sleeve towards the component striking direction of the striking rod and a third biasing device arranged for biasing a ferrule towards the component striking direction of the striking rod.

3. The auto hammer of claim 1, wherein the auto hammer comprises a housing, a motor mounted vertically in the housing, and a transmission mechanism arranged in the housing for converting rotating motions of the motor into impact motions of the striking rod via a bevel gear and an impact wheel.

4. The auto hammer of claim 1, wherein the sleeve is provided with slots on at least two sides thereof, the slots on each side are symmetric to each other, and the clamping elements comprise driving portions which are disposed in the slots and movable along the slots.

5. The auto hammer of claim 4, wherein the clamping mechanism comprises four clamping elements, the sleeve is provided with slots on four sides thereof, the slots on each side are symmetric to each other, and the clamping elements comprises driving portions which are disposed in the slots and movable along the slots.

6. The auto hammer of claim 1, wherein the slots are flexural-type.

7. The auto hammer of claim 4, wherein the driving portions are removably mounted on the clamping elements.

8. The auto hammer of claim 4, wherein the driving portions are integrally formed with the clamping elements.

9. The auto hammer of claim 1, wherein the striking rod passes through a released region formed by the clamping elements at the opened position.

10. The auto hammer of claim 9, wherein the bush passes through the released region.

11. The auto hammer of claim 1, wherein the clamping elements are interlockable.

12. The auto hammer of claim 1, wherein the clamping mechanism includes a locking mechanism.

13. The auto hammer of claim 12, wherein the locking mechanism includes at least one protrusion and a spanner.

14. The auto hammer of claim 13, wherein the clamping elements are located at the opened position after the one protrusion and the spanner are locked.

15. The auto hammer of claim 13, wherein the bush is exposed from the sleeve after the one protrusion and the spanner are locked.

16. The auto hammer of claim 1, wherein the sleeve is provided with a sheath.

17. The auto hammer of claim 16, wherein a toggle switch engages with the sheath for moving together therewith.

18. The auto hammer of claim 16, wherein at least one of the sheath and the sleeve are composed of a transparent material.

19. The auto hammer of claim 16, wherein at least one of the sheath and the sleeve are provided with recesses thereon.

* * * * *